US007549183B2

(12) United States Patent
Dockendorf et al.

(10) Patent No.: US 7,549,183 B2
(45) Date of Patent: Jun. 23, 2009

(54) CONVERTIBLE PILLOW SYSTEM AND ASSOCIATED METHODS

(76) Inventors: Annemarie V. Dockendorf, 3740 Brennan Dr., Melbourne, FL (US) 32934; Kirk Paul Dockendorf, 3740 Brennan Dr., Melbourne, FL (US) 32934

( * ) Notice: Subject to any disclaimer, the term of this patent is extended or adjusted under 35 U.S.C. 154(b) by 303 days.

(21) Appl. No.: 11/563,254

(22) Filed: Nov. 27, 2006

(65) Prior Publication Data

US 2007/0220679 A1 Sep. 27, 2007

Related U.S. Application Data

(60) Provisional application No. 60/784,600, filed on Mar. 22, 2006.

(51) Int. Cl.
*A47D 7/00* (2006.01)

(52) U.S. Cl. ..... 5/655; 5/657; 5/652; 5/425; 5/640

(58) Field of Classification Search ..... 5/655, 5/636, 640, 657, 417, 420, 652, 657.5, 425, 5/427

See application file for complete search history.

(56) References Cited

U.S. PATENT DOCUMENTS

| | | | | |
|---|---|---|---|---|
| 2,626,407 | A * | 1/1953 | Kurry | 5/99.1 |
| 4,999,863 | A * | 3/1991 | Kane | 5/98.1 |
| 5,035,013 | A | 7/1991 | Bloom | |
| 5,088,139 | A | 2/1992 | Bloom | |
| 5,103,514 | A * | 4/1992 | Leach | 5/417 |
| D330,139 | S | 10/1992 | Bloom | |
| 6,026,525 | A * | 2/2000 | Davis | 5/99.1 |
| 6,199,230 | B1 * | 3/2001 | Parikh | 5/420 |
| 6,408,463 | B1 * | 6/2002 | Palacio | 5/424 |
| 6,754,924 | B1 | 6/2004 | Brady et al. | |
| 2007/0220679 | A1 * | 9/2007 | Dockendorf et al. | 5/655 |
| 2007/0245494 | A1 * | 10/2007 | Dockendorf | 5/655 |

OTHER PUBLICATIONS www.onestopbaby.com, Pregnancy Body Pillows.
www.sitincomfort.com, Maternity Pillow, The Comfort Store.

* cited by examiner

*Primary Examiner*—Michael Trettel

(57) ABSTRACT

A combination pillow and enclosed area system includes an enclosing bottom member, and a plurality of bumper members. The enclosing bottom member is moveable between folded and unfolded positions and includes a closure device connected thereto that is moveable between opened and closed positions. The plurality of bumper members are carried by the enclosing bottom member. The enclosing bottom member and plurality of bumper members form an enclosed area when the enclosing bottom member is in the unfolded position, and a pillow when the enclosing bottom member is in the folded position.

38 Claims, 7 Drawing Sheets

CONVERTIBLE PILLOW SYSTEM AND ASSOCIATED METHODS

RELATED APPLICATIONS

This application claims the benefit of U.S. Provisional Patent Application Ser. No. 60/784,600 filed on Mar. 22, 2006, the contents of which are incorporated herein by reference in its entirety, and is related to U.S. Provisional Patent Application Ser. No. 60/787,269 filed on Mar. 30, 2006, and U.S. Provisional Patent Application Ser. No. 60/839,553 filed on Aug. 23, 2006, the contents of both of which are also incorporated herein by reference in their entireties.

FIELD OF THE INVENTION

The present invention relates to the field of pillows and infant play areas and, more particularly, to the field of pillows that are convertible to infant play areas, and related methods.

BACKGROUND OF THE INVENTION

During pregnancy, a woman may require additional support adjacent the belly area while sleeping. More specifically, the enlarged belly of a pregnant woman may cause discomfort while sleeping. Accordingly, several maternity or body pillows exist to provide some support adjacent the belly of a pregnant women.

One such pillow, for example, is distributed by "The Comfort Store" under the tradename "The Bean Maternity Pillow". This pillow includes a pair of smaller pillows that are connected to one another using a hook and loop fastener. One of the pair of pillows is to be positioned adjacent the belly of the user, and the other pillow is to be positioned adjacent the lower back of the user. The positioning of the pair of pillows is intended to provide support to the belly and lower back of the pregnant woman.

Another such pillow, for example, is distributed by "One-Stop Baby" under the tradename "Pregnancy Body Pillow". This pillow includes a pair of elongate pillows that are connected to one another using a hook and loop fastener. The pair of pillows are to be positioned to extend adjacent the length of the user so that the pillows may support the belly portion and rear of the pregnant woman.

These pillows may, however, not have a use to the woman after her pregnancy is over. Therefore, the user is required to find storage space for the pillows when not in use. This may be a greater issue for the "Pregnancy Body Pillow" as it includes elongate pillows.

After the infant is born, parents may find it necessary to provide an enclosed area within which the infant may sleep or play. In cases when a family is traveling, and also in cases when a crib or play pen may not be available, parents sometimes place the infant in what may be considered improper, and sometimes unsafe, enclosed areas. For example, some parents may lay the infant on a bed, and form an enclosed area using pillows.

Some portable play areas exist to provide parents with an enclosed area to be used for the infant. For example, U.S. Pat. No. 5,035,013 to Bloom discloses a foldable infant play mat. The foldable infant play mat includes a base and a circular pillow carried by the base. The circular pillow may be removed from the base, as illustrated, for example, in FIG. 6. The base may be folded and the circular pillow enclosed therein to form a half-circle folded play mat to be transported by the user.

U.S. Pat. No. 5,088,139, also to Bloom discloses a portable play mat and carrying case. The play mat includes a circular base, and a circular pillow carried by the base. The carrying case is stitched to the base along the bottom and provides a pocket within which the circular base and the circular pillow may be positioned. The carrying case includes a zipper closure and a handle.

U.S. Pat. No. 6,408,463 to Palacio discloses a baby play mat having a base and removable bumpers. The removable bumpers are carried by an upper portion of the base and may be connected to one another using hook and loop fasteners. The bumpers may be stacked to provide greater height to the enclosed area. Such a play area, however, may be cumbersome to transport, and may be complicated to assemble.

Accordingly, there exist elongate pillows and play areas. Therefore, a pregnant woman may require the use of an elongate maternity pillow during her pregnancy, and will likely require storage space for the pillow after her pregnancy is completed. Thereafter, after the infant is born, parents may purchase a portable play area for the infant. This is disadvantageously cost ineffective, and requires still further storage space.

SUMMARY OF THE INVENTION

In view of the foregoing background, it is therefore an object of the present invention to provide a combination pillow and enclosed area system that advantageously provides support to a pregnant women during her pregnancy and provides a portable enclosed area to be used by an infant. It is also an object of the present invention to provide an enclosed area that is simple to use and convert to a pillow.

These and other objects, features, and advantages in accordance with the present invention are provided by a combination pillow and enclosed area system comprising an enclosing bottom member and a plurality of bumper members. The enclosing bottom member is preferably moveable between folded and unfolded positions and includes a closure device connected to an outer peripheral portion thereof. The closure device may be moveable between opened and closed positions. The plurality of bumper members may be carried by the enclosing bottom member.

The enclosing bottom member and the plurality of bumper members preferably form an enclosed area when the enclosing bottom member is in the unfolded position. The enclosed area has a bottom defined by the enclosing bottom member and a plurality of sidewalls defined by the plurality of bumper members connected to and overlying the outer peripheral portion of the enclosing bottom member.

The enclosing bottom member and the plurality of bumper members preferably form a pillow when the enclosing bottom member is in the folded position. The pillow may have an outer lining portion defined by the enclosing bottom member, and an inner portion defined by the plurality of bumper members. Accordingly, the combination pillow and enclosed area system advantageously provide a pregnant woman with necessary support during her pregnancy and an infant with an enclosed area after birth. The system also eliminates additional items necessary for a parent to purchase after the infant has been born.

The plurality of bumper members may be detachably connected to one another when the enclosing bottom member is in the unfolded position. More particularly, the plurality of bumper members may be detachably connected to one another using a hook and loop fastener.

The plurality of bumper members may include first, second, third, and fourth bumper members. In one embodiment of the system, the plurality of bumper members are preferably fixedly connected to an outer peripheral portion of the enclosing bottom member. In another embodiment of the system, the plurality of bumper members may be detachably connected to outer peripheral portions of the enclosing bottom member. More specifically, the plurality of bumper members may be detachably connected to the enclosing bottom member using a hook and loop fastener.

The first and second bumper members may be elongate bumper members, each having a first predetermined length. The third and fourth bumper members may each comprise a pair of bumper members. Each one of the bumper members in the pair of bumper members may have a second predetermined length shorter than the first predetermined length. The bumper members in the pair of bumper members are preferably joined together by a seam. Each of the third and fourth bumper members may be foldable along the seam.

In still another embodiment of the system, the first and second bumper members may be fixedly connected to opposing outer peripheral portions of the bottom enclosing member and the seams of the third and fourth bumper members may be fixedly connected to opposing medial outer peripheral portions of the enclosing bottom member. The third and fourth bumper members may fold inwardly along the seam towards the medial portion of the enclosing bottom member and the first and second bumper members may be positioned to overlie the third and fourth bumper members when the enclosing bottom member is moved from the unfolded position to the folded position to form a pillow.

In yet another embodiment of the system, the first bumper member may be fixedly connected to the outer peripheral portion of the enclosing bottom member, and the second, third, and fourth bumper members may be detachably connected to the outer peripheral portions of the enclosing bottom member. Accordingly, when the enclosing bottom member is moved from the unfolded position to the folded position, the second bumper member may slide towards the first bumper member and the third and fourth bumper members may fold inwardly along the seams to position the seams adjacent an interior medial portion of the enclosing bottom member. Thereafter, the first, second, third, and fourth bumper members may be positioned adjacent one another when the enclosing bottom member is moved from the unfolded position to the folded position to form a pillow.

The system may also include a lining overlying the enclosing bottom member. The closure device may be a zipper or a plurality of snap fasteners. The system may also include a handle that is fixedly connected to the outer peripheral portion of the enclosing bottom member.

A method aspect of the present invention is for converting a combination pillow and enclosed area system from an enclosed area to a pillow. The method may include folding the third and fourth bumper members inwardly toward a medial portion of the enclosing bottom member, and folding the enclosing bottom member upwardly so that the first and second bumper members overlie the third and fourth bumper members when the enclosing bottom member is moved from the unfolded to the folded position.

Another method aspect of the present invention is also for converting a combination pillow and enclosed area system from an enclosed area to a pillow. This method may include detaching the second, third, and fourth bumper members from outer peripheral portions of the enclosing bottom member. The method may also include sliding the second bumper member towards the first bumper member that is fixedly connected to the outer peripheral portion of the enclosing bottom member, and folding the third and fourth bumper members inwardly as the second bumper member is moved towards the first bumper member so that the first, second, third, and fourth bumper members are adjacent one another when the enclosing bottom member is moved to the folded position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
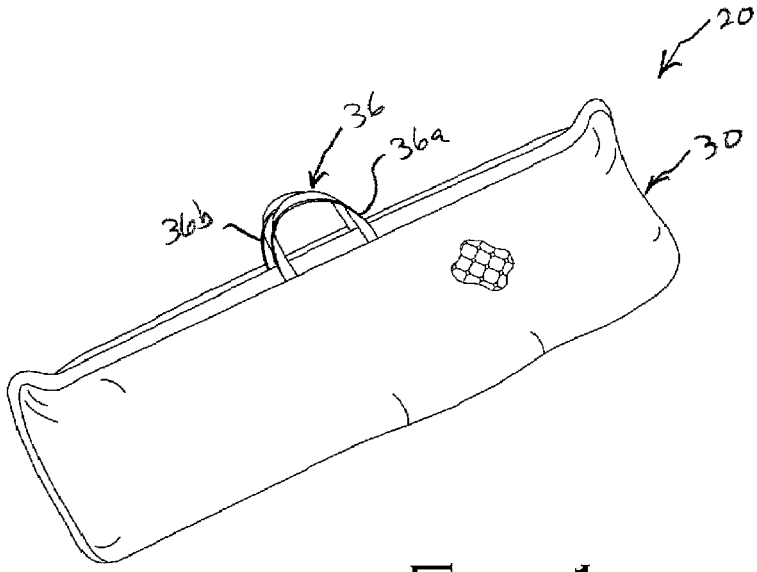
FIG. 1 is a front perspective view of a combination pillow and enclosed area system according to the present invention.
Figure 2:
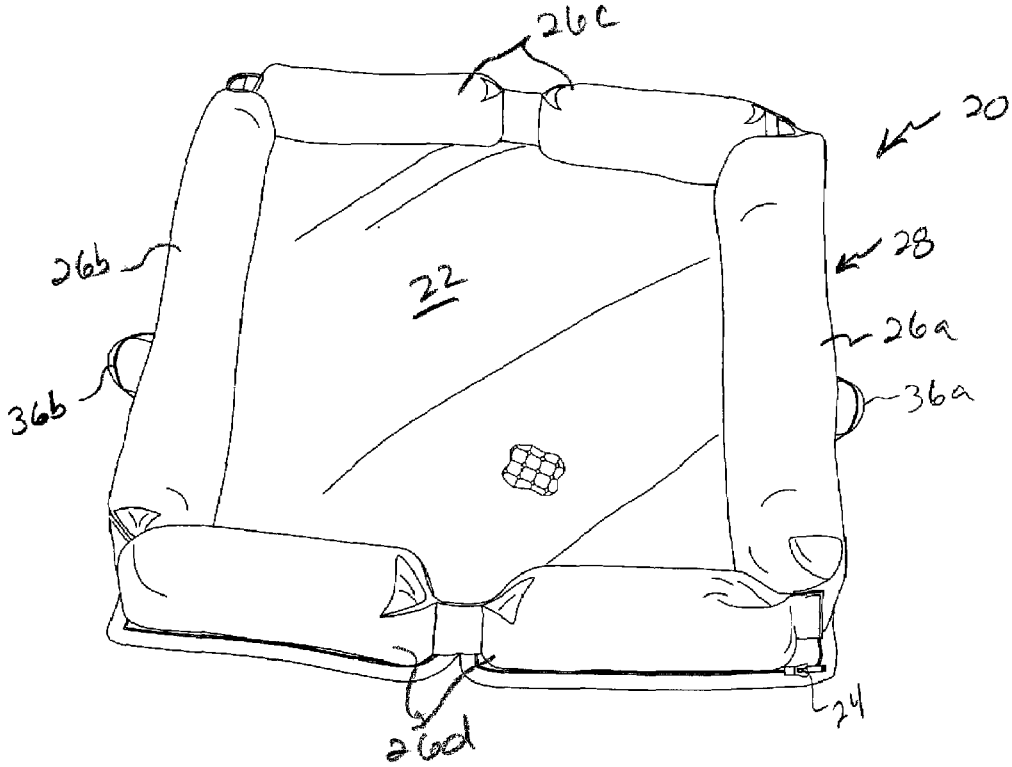
FIG. 2 is a perspective view of the combination pillow and enclosed area system illustrated in FIG. 1 showing an enclosing bottom member in an updated position.

Referring initially to FIGS. 1 and 2, the combination pillow and enclosed area system 20 according to the present invention is now described in greater detail. The system 20 illustratively includes an enclosing bottom member 22 that is moveable between folded and unfolded positions. The enclosing bottom member 22 includes a closure device 24 connected to an outer peripheral portion thereof. The closure device 24 is moveable between open and closed positions.

The system 20 also includes a plurality of bumper members 26 that are carried by the enclosing bottom member 22. As perhaps best illustrated in FIG. 2, the plurality of bumper members 26 are preferably positioned adjacent the outer peripheral portions of the enclosing bottom member 22 when the enclosing bottom member is in the unfolded position.

As further illustrated in FIG. 2, the enclosing bottom member 22 and the plurality of bumper members 26 form an enclosed area 28 when the enclosing bottom member is in the unfolded position. The enclosed area 28 has a bottom defined by the enclosing bottom member 22 and a plurality of side walls defined by the plurality of bumper members 26 connected to and overlying the outer peripheral portion of the enclosing bottom member. The enclosed area 28 may advantageously be used as an infant play area, for example, or an area in which a parent may lay an infant to sleep or rest.

As perhaps best illustrated in FIG. 1, the enclosing bottom member 22 and the plurality of bottom members 26 may form a pillow 30 when the enclosing bottom member is in the folded position. The pillow 30 has an outer lining portion defined by the enclosing bottom member 22 and an inner portion defined by the plurality of bumper members 26. Therefore, the combination pillow and enclosed area system 20 of the present invention advantageously provides a pregnant woman with a pillow 30 for support during her pregnancy, and an infant with an enclosed area 28. Accordingly, the pillow 30 will have a use after the woman's pregnancy has been completed, and does not require storage. Further, the pillow is preferably of a shape and size that allows a user to readily use it for any other support purpose, e.g., head and neck support.

Figure 3:
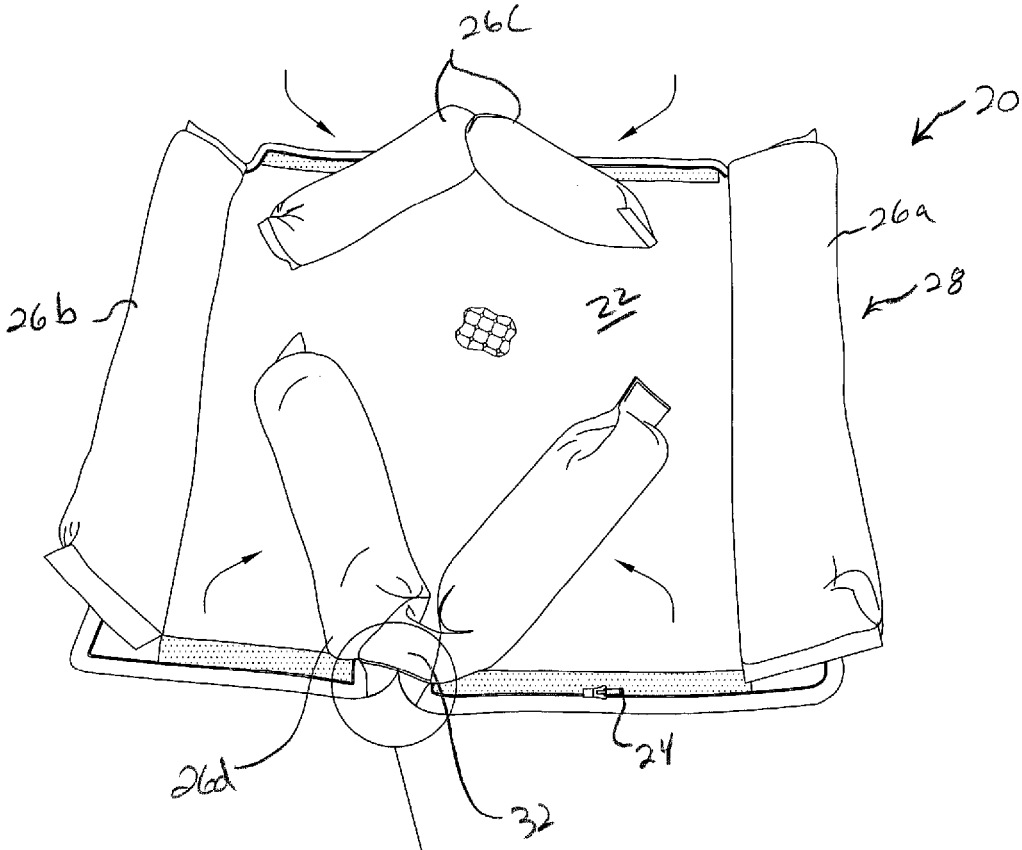
FIG. 3 is a perspective view of one embodiment of the combination pillow and enclosed area system having the enclosing bottom member being moved from the unfolded position to the folded position
Figure 4:
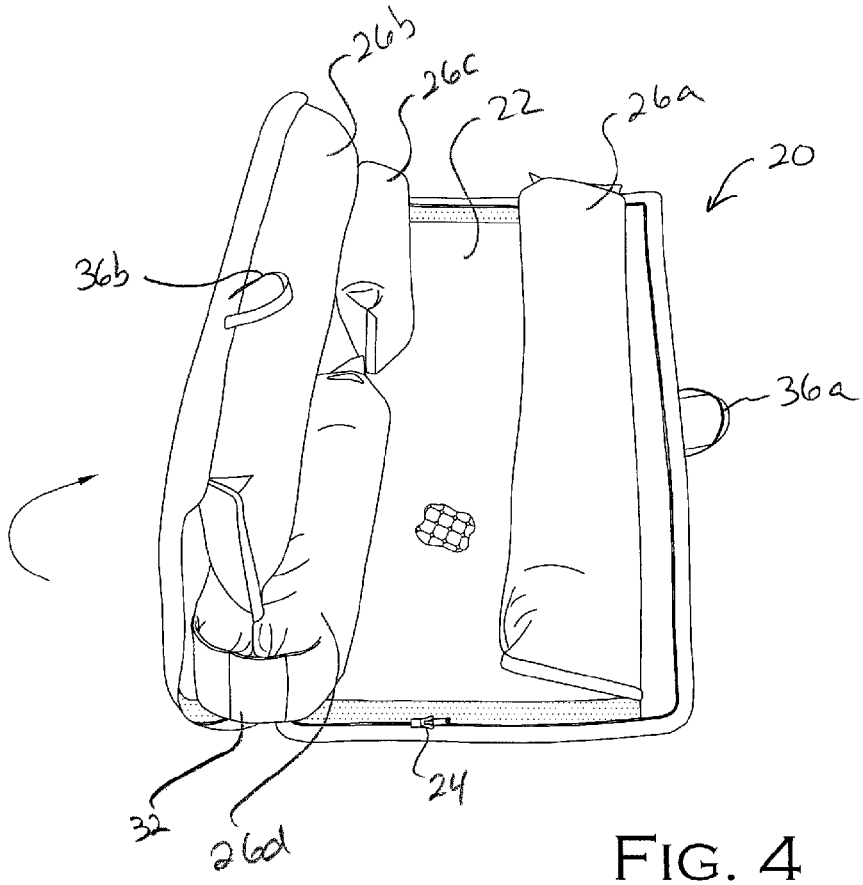
FIG. 4 is a perspective view of one embodiment of the combination pillow and enclosed area system having the enclosing bottom member being moved from the unfolded position to the folded position.
Figure 5:
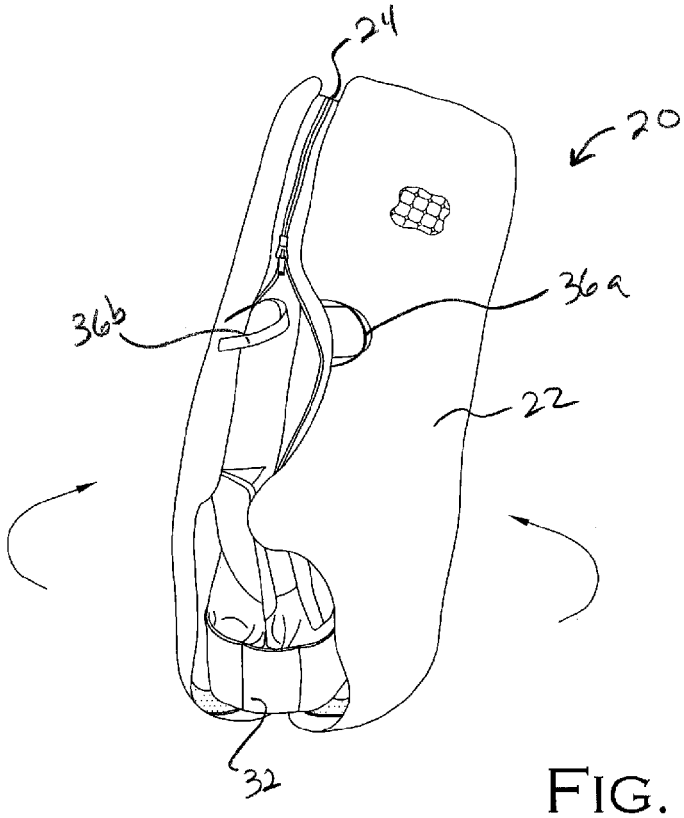
FIG. 5 is a perspective view of the combination pillow and enclosed area system illustrated in FIGS. 3-4 having a closure device being moved from an open position to a closed position to form a pillow.

Referring now additionally to FIGS. 3-5, the combination pillow and enclosed area system 20 is described in greater detail. The plurality of bumper members 26 illustratively includes a first 26*a*, second 26*b*, third 26*c*, and fourth 26*d* bumper member. Each of the plurality of bumper members 26*a*, 26*b*, 26*c*, 26*d*, may be fixedly connected to an outer peripheral portion of the enclosing bottom member 22. More specifically, the plurality of bumper members 26*a*, 26*b*, 26*c*, 26*d*, may be fixedly connected to the enclosing bottom member 22 by a sewn connection. Those skilled in the art will appreciate that the bumper members 26*a*, 26*b*, 26*c*, 26*d*, are fixedly connected to the enclosing bottom member 22 in a manner that does not allow for the bumper members to be readily removed from the enclosing bottom member 22. A sewn connection is preferred, but other connections that allow for the plurality of bumper members 26*a*, 26*b*, 26*c*, 26*d*, to be fixedly connected to the enclosing bottom member 22 may also be used, as understood by those skilled in the art.

Figure 3A:
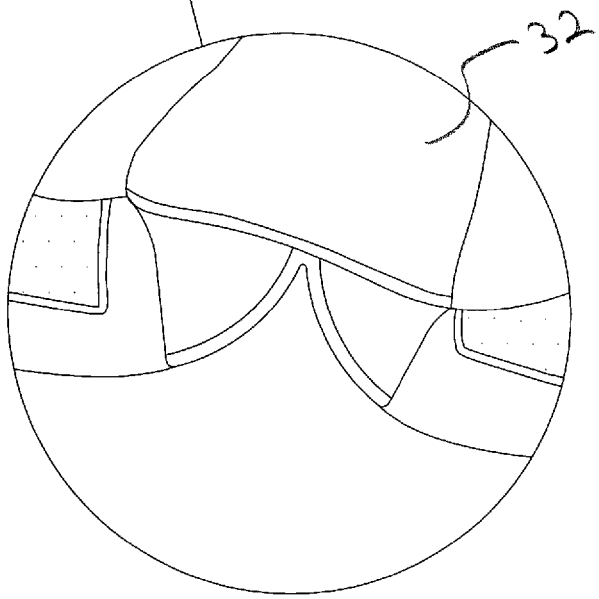
FIG. 3*a* is a blow up of a portion of the combination pillow and enclosed area system showing a seam between the bumper members.

As perhaps best illustrated in FIG. 3, the first and second bumper members 26*a*, 26*b*, have a first predetermined length. The predetermined length of the first and second bumper members 26*a*, 26*b* is preferably substantially similar to the length of the outer peripheral portion of the enclosing bottom member 22 positioned adjacent the respective bumper member. The third and fourth bumper members 26*c*, 26*d* each illustratively comprise a pair of bumper members. Each one of the bumper members in the pair of bumper members have a second predetermined length that is shorter than the first predetermined length. The pair of bumper members in the third and fourth bumper members 26*c*, 26*d*, are preferably joined together by a seam 32. Additional detail of the seam 32 is illustrated, for example, in FIG. 3*a*. The third and fourth bumper members 26*c*, 26*d* are foldable along the seam 32.

Operation of this embodiment of the combination pillow and enclosed area system 20 is now described in greater detail. In this embodiment, the first and second bumper members 26*a*, 26*b* are fixedly connected to opposing outer peripheral portions of the bottom enclosing member 22. More specifically, and as referenced above, the first and second bumper members 26*a*, 26*b* may be sewn to the enclosing bottom member 22. The sewn connection between the first and second bumper members 26*a*, 26*b*, preferably extends substantially the length of the bumper member.

The seam 32 of each of the third and fourth bumper members 26*c*, 26*d* are also preferably fixedly connected to opposing medial outer peripheral portions of the enclosing bottom member 22. The fixed connection between the third and fourth bumper members 26*c*, 26*d* is preferably a sewn connection that extends substantially the length of the seam 32. When converting the enclosed area 28 of the combination pillow and enclosed area system 20 to a pillow 30, the third and fourth bumper members 26*c*, 26*d* fold inwardly along the seam 32 towards a medial portion of the enclosing bottom member 22. When the third and fourth bumper members 26*c*, 26*d* are folded inwardly towards the medial portion of the enclosing bottom member 22, the opposing ends of the third and fourth bumper members are illustratively positioned adjacent one another. Thereafter, the enclosing bottom member 22 may be folded so that the first and second bumper members 26*a*, 26*b* are positioned to overlie the third and fourth bumper members 26*c*, 26*d*. The enclosing bottom member 22 is folded so that the fold is adjacent the medial portion thereof.

As further illustrated in FIG. 5, after the first and second bumper members 26*a*, 26*b* have been positioned to overlie the third and fourth bumper members 26*c*, 26*d* and the enclosing bottom member 22 is moved from the unfolded position to the folded position, the closure device 24 may be moved from the open position to the closed position to thereby form a pillow 30. As further illustrated in FIG. 5, the closure device 24 is positioned on the enclosing bottom member 22 in such a way that allows material from the enclosing bottom member to cover the closure device. This advantageously allows a user to use the pillow without interference from the closure device.

Figure 6:
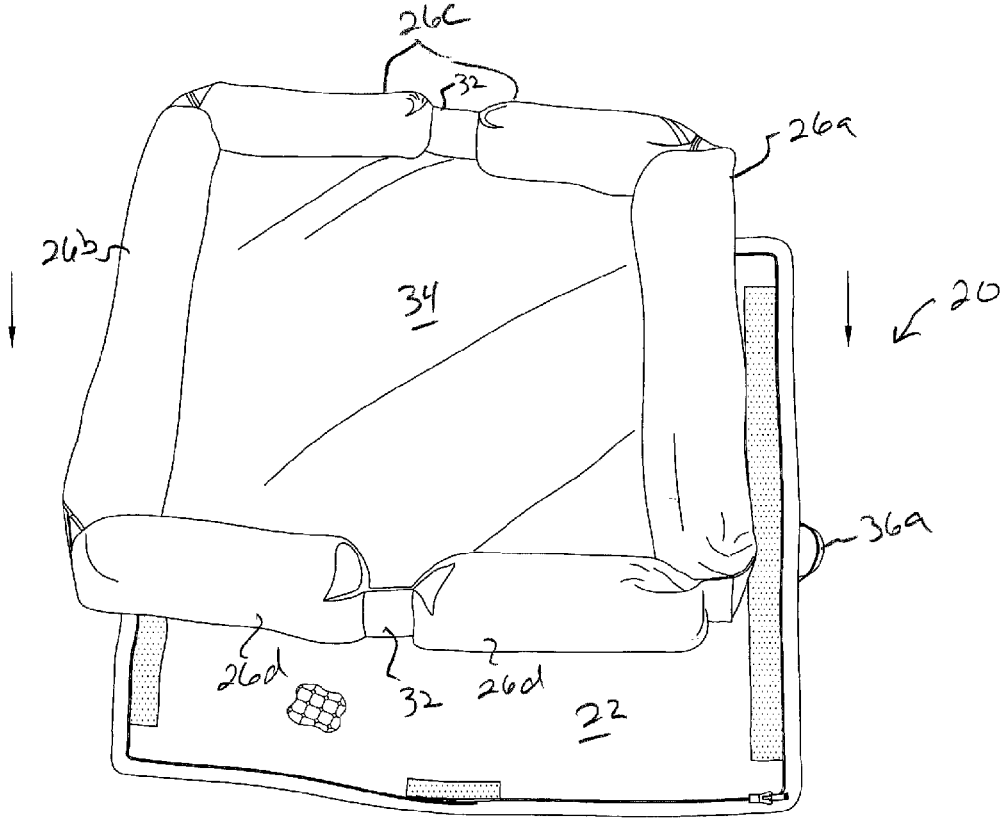
FIG. 6 is a perspective view of the combination pillow and enclosed area system illustrated in FIG. 1 having a plurality of bumper members that are detachably connected from the enclosing bottom member.

Referring now additionally to FIG. 6, the plurality of bumper members 26*a*, 26*b*, 26*c*, 26*d* are illustratively detachably connected to the outer peripheral portion of the enclosing bottom member 22. More specifically, the plurality of bumper members 26*a*, 26*b*, 26*c*, 26*d* are detachably connected to the enclosing bottom member using a plurality of hook and loop fasteners. The hook and loop fasteners are illustrated in FIG. 6 as extending substantially the length of one of the peripheral side portions of the enclosing bottom member 22 and adjacent a medial outer peripheral portion of the enclosing bottom member. Those skilled in the art, however, will appreciate that the hook and loop fasteners may be positioned in any configuration suitable to allow the plurality of bumper members 26*a*, 26*b*, 26*c*, 26*d* to be detachably connected from the enclosing bottom member 22. Those skilled in the art will also appreciate that the plurality of bumper members 26*a*, 26*b*, 26*c*, 26*d* may be detachably connected from the enclosing bottom member 22 using any other type of fastener suitable for allowing a user to readily connect and detach the plurality of bumper members from the enclosing bottom member.

The detachability of the plurality of bumper members 26*a*, 26*b*, 26*c*, 26*d* from the enclosing bottom member 22 advantageously allows a user to readily wash the enclosing bottom member and the plurality of bumper members in a washing machine. Of course, the material of the plurality of bumper members 26*a*, 26*b*, 26*c*, 26*d* and the enclosing bottom member 22 are preferably a machine washable material, but those skilled in the art will appreciate that the material of the enclosing bottom member and the plurality of bumper members may be any material desired by a user.

Figure 7:
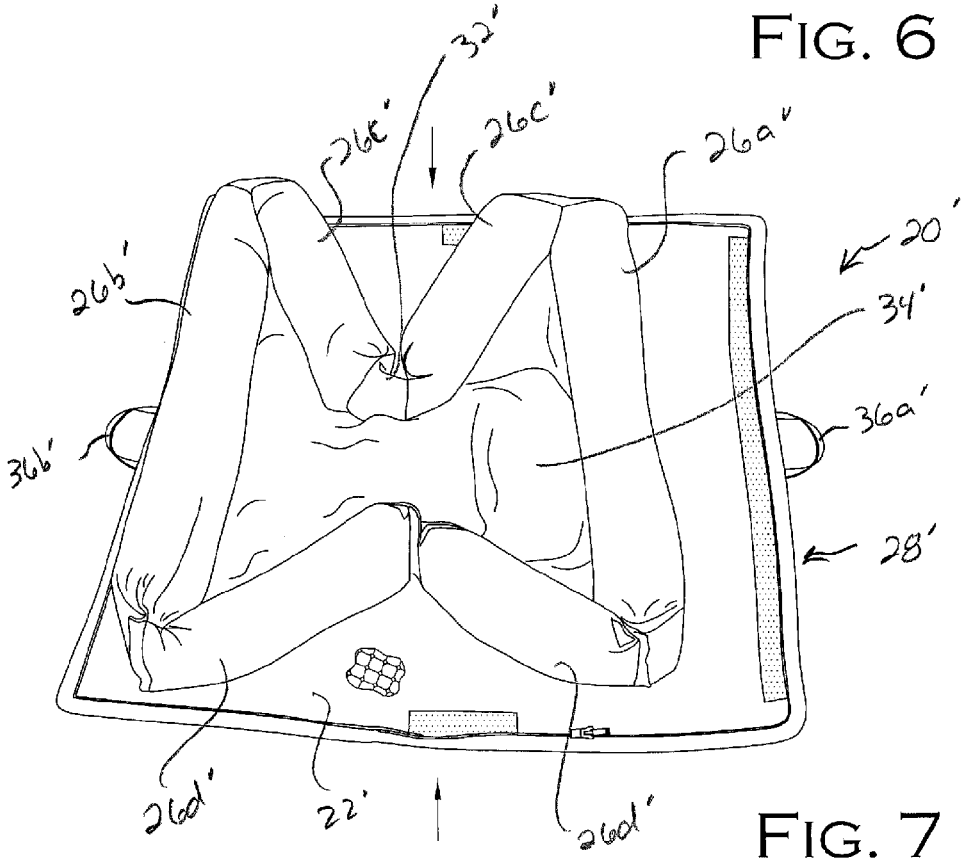
FIG. 7 is a perspective view of another embodiment of the combination pillow and enclosed area system showing the enclosing bottom member being moved from the unfolded position to the folded position.
Figure 8:
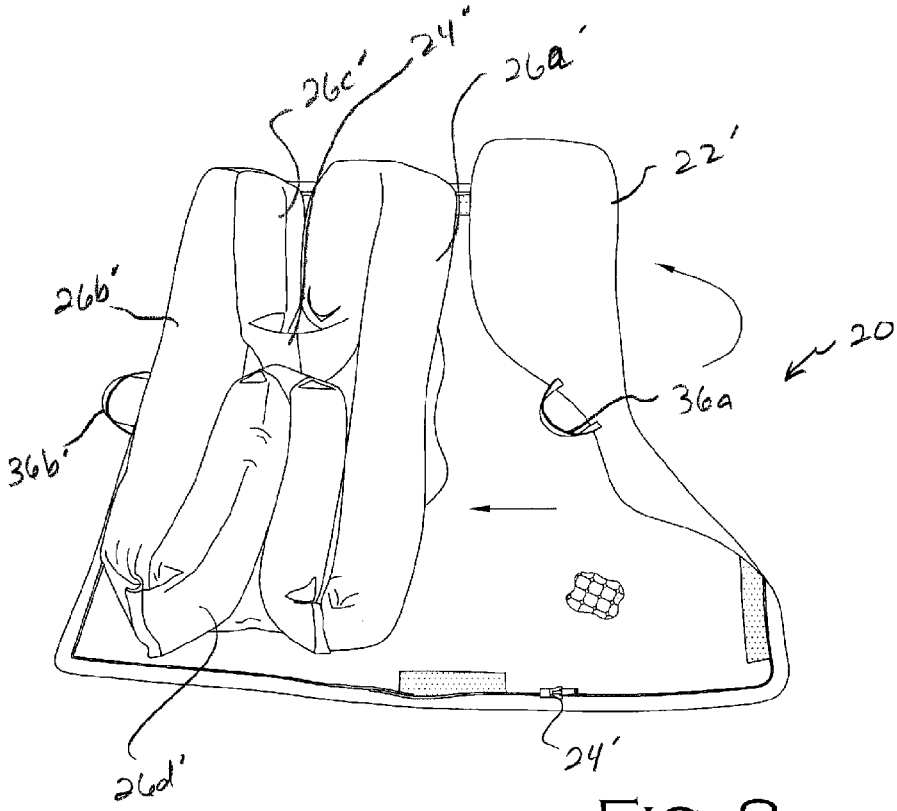
FIG. 8 is a perspective view of another embodiment of the combination pillow and enclosed area system showing the enclosing bottom member being moved from the unfolded position to the folded position.
Figure 9:
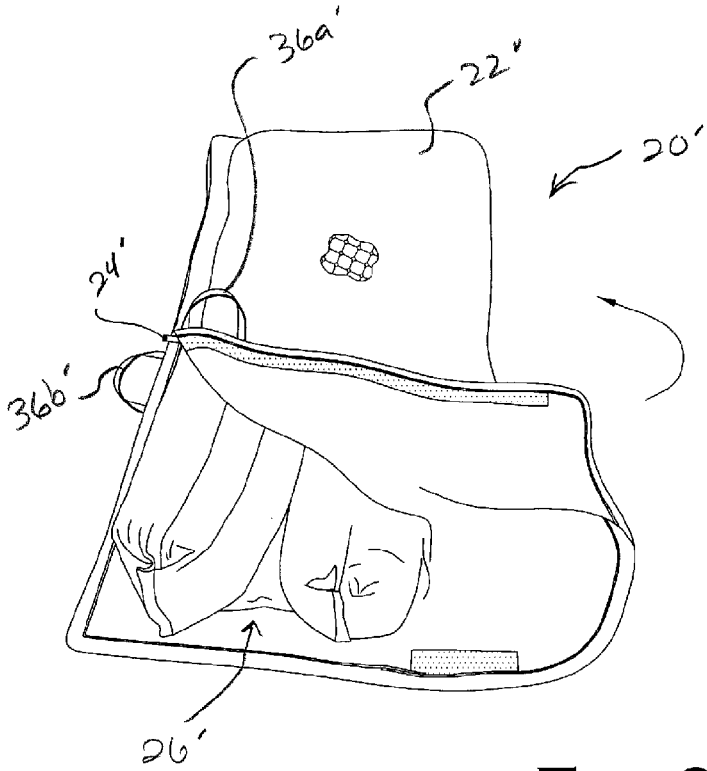
FIG. 9 is a perspective view of the combination pillow and enclosed area system illustrated in FIGS. 7-8 having the closure device being moved from the opened to the closed positions.

Referring now additionally to FIGS. 7-9, another embodiment of the combination pillow and enclosed area system 20' is now described in greater detail. In this embodiment of the system 20', the first bumper member 26*a*' is fixedly connected to the outer peripheral portion of the enclosing bottom member 22'. The second, third and fourth bumper members 26*b*', 26*c*', 26*d*', are preferably detachably connected to the outer peripheral portions of the enclosing bottom member 22'. Similar to the first embodiment of the combination pillow and enclosed area system 20, in the second embodiment of the system 20', the first bumper member 26*a*' is preferably fixedly connected to the enclosing bottom member 22' using a sewn connection. Further, the second, third and fourth bumper members 26*b*', 26*c*', 26*d*', are preferably detachably connected to the enclosing bottom member 22' using hook and loop fasteners.

When the enclosing bottom member 22' is moved from the unfolded position to the folded position, the second bumper member 26*b*' illustratively slides towards the first bumper member 26*a*', and the third and fourth bumper members 26*c*', 26*d*' fold inwardly along the seams 32' to position the seams adjacent an interior medial portion of the enclosing bottom member. Accordingly, and as perhaps best illustrated in FIG. 8, the first, second, third and fourth bumper members 26*a*', 26*b*', 26*c*', 26*d*' are positioned adjacent one another when the enclosing bottom member 22' is moved from the unfolded position to the folded position. Thereafter, and as perhaps best illustrated in FIGS. 9 and 10, the closure device 24' may be moved from the open position to the closed position to form a pillow 30'. The other elements of this embodiment of the combination pillow and enclosed area system 20' are similar to those of the first embodiment of the combination pillow and enclosed area system 20, are labeled with prime notation, and require no further discussion herein.

Figure 10:
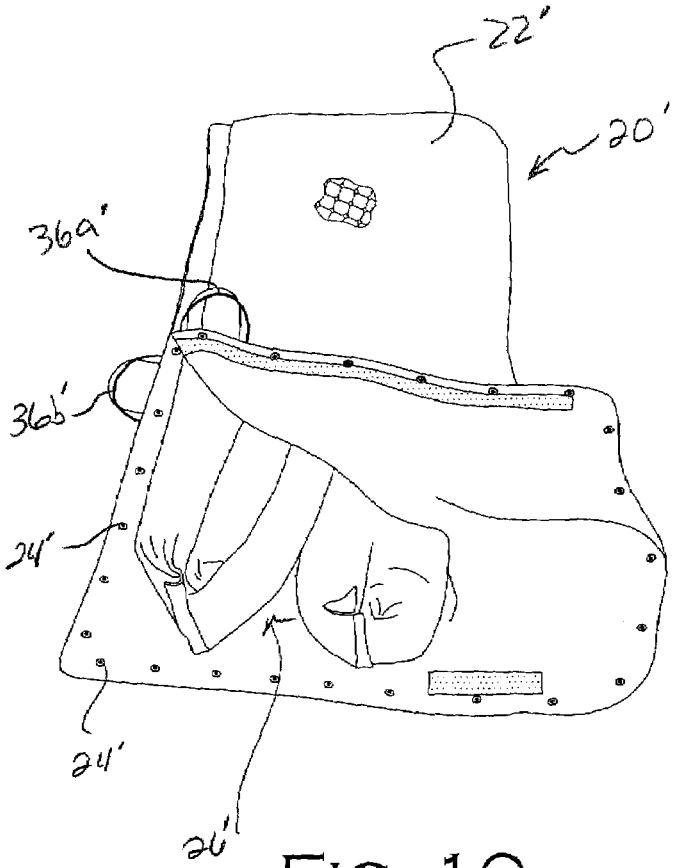
FIG. 10 is a perspective view of the combination pillow and enclosed area system illustrated in FIGS. 7-8 and having another type of closure device being moved from the open position to the closed position.

As illustrated in FIG. 9, the closure device 24' is provided by a zipper positioned adjacent the outer peripheral portions of the enclosing bottom member 22'. As illustrated in FIG. 10, the closure device 24' may also be provided by snap fasteners. Those skilled in the art will appreciate that the closure device may also be provided by any other type of fastener suitable for securing the outer peripheral portions of the enclosing bottom member 22' to enclose the plurality of bumper members 26*a*', 26*b*', 26*c*', 26*d*' therein to thereby form a pillow 30'.

As illustrated in FIG. 6, the combination pillow and enclosed area system 20 may also include a lining 34 overlying the enclosing bottom member 22. The lining 34 is preferably connected to each of the plurality of bumper members 26*a*, 26*b*, 26*c*, 26*d*, and provides an area upon which an infant may be laid when the combination pillow and enclosed area system 20 is positioned in the form of the enclosed area 28. The lining 34 is preferably a soft material, such as silk or satin, or any other similar material to advantageously enhance comfort for the infant. Further, the material is preferably machine washable, but those skilled in the art will appreciate that any material may be used for the lining 34.

Referring now back to FIG. 1, the combination pillow and enclosed area system 20 preferably includes a handle 36 fixedly connected to the outer peripheral portion of the enclosing bottom member 22. More specifically, the handle 36 preferably includes a pair of handle members 36*a*, 36*b* fixedly connected to opposing outer peripheral portions of the enclosing bottom member 22. Accordingly, when the enclosing bottom member 22 is in the folded position, the pair of handle members 36*a*, 36*b* are positioned adjacent one another to form a single handle 36. Further, the handle members 36*a*, 36*b*, are preferably sewn to the enclosing bottom member 22. Those skilled in the art, however, will appreciate that the handle members 36*a*, 36*b* may be fixedly connected to the enclosing bottom member 22 using any other suitable fastening means. The handle 36 advantageously enhances a user's ability to transport the combination pillow and enclosed area system 20.

Figure 11:
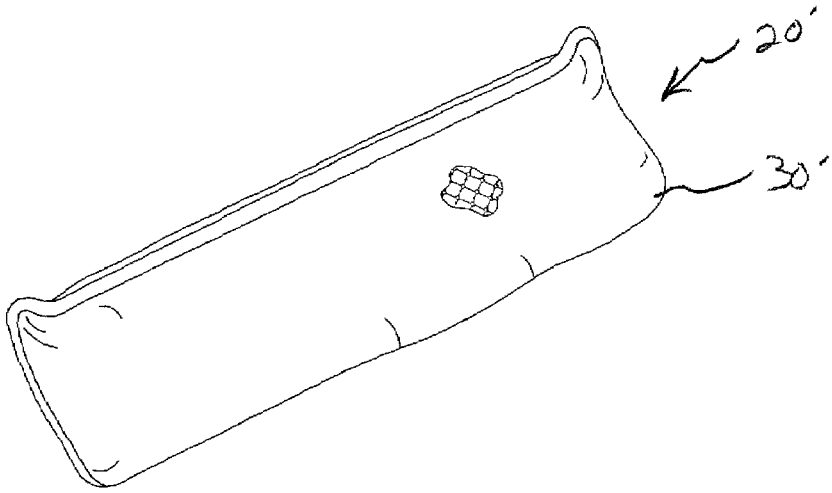
FIG. 11 is a perspective view of the combination pillow and enclosed area system in the form of a pillow.

Those skilled in the art will appreciate that the combination pillow and enclosed area system 20 may also be provided without a handle, as illustrated, for example, in FIG. 11. Eliminating the handle 36 of the combination pillow and enclosed area system 20 may advantageously enhance comfort when being used as a pillow 30.

Figure 12:
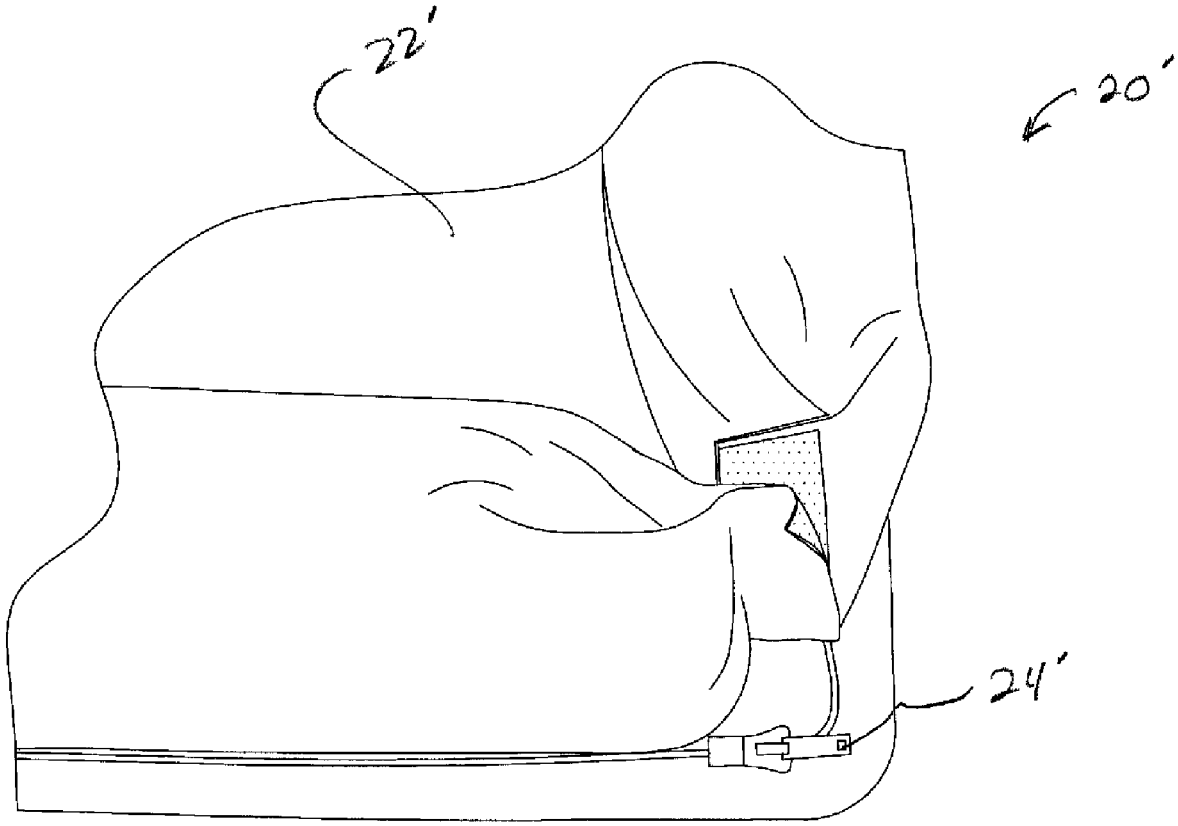
FIG. 12 is a partial perspective view of the combination pillow and enclosed area system showing the bumper members being detachably connected to one another.

Referring now back to FIG. 3 and additionally to FIG. 12, the plurality of bumper members 26 may be detachably connected to one another when the enclosing bottom member 22 is in the unfolded position. The plurality of bumper members 26 may be detachably connected to one another using a hook and loop fastener. Those skilled in the art, however, will appreciate that the plurality of bumper members 26 may be connected to one another using any other type of fastener. The positioning of the hook and loop fasteners adjacent the ends of each of the plurality of bumper members 26*a*, 26*b*, 26*c*, 26*d* is advantageous as it is less likely to be exposed when the combination pillow and enclosed area system 20 is used as an enclosed area. Accordingly, an infant laid within the enclosed area 28 is less likely to be scratched by the sometimes abrasive surface of a hook and loop fastener.

A method aspect of the present invention is for converting the combination pillow and enclosed area system 20 from an enclosed area 28 to a pillow 30, as illustrated, for example, in FIGS. 3-5. The method includes folding the third and fourth bumper members 26*c*, 26*d* inwardly toward the medial portion of the enclosing bottom member 22. The method also includes folding the enclosing bottom member 22 so that the first and second bumper members 26*a*, 26*b* overlie the third and fourth bumper members 26*c*, 26*d* when the enclosing bottom member is moved from the unfolded to the folded position.

Another method aspect of the present invention is also for converting a combination pillow and enclosed area system 20' from an enclosed area 38' to a pillow 30', as illustrated, for example, in FIGS. 7-9. The method may include detaching the second, third and fourth bumper members 26*b*', 26*c*', 26*d*' from the outer peripheral portions of the enclosing bottom member 22' and may also include sliding the second bumper member 26*b*' toward the first bumper member 26*a*' that is fixedly connected to the outer peripheral portion of the enclosing bottom member 22'. The method further includes folding the third and fourth bumper members 26*c*', 26*d*' inwardly as the second bumper member 26*b*' is moved towards the first bumper member 26*a*' so that the first, second, third and fourth bumper members are adjacent one another when the enclosing bottom member 22' is moved to the folded position.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A combination pillow and enclosed area system comprising: an enclosing bottom member moveable between folded and unfolded positions and comprising a closure device connected to an outer peripheral portion thereof and moveable between opened and closed positions; and a plurality of bumper members by separable from and attached to said enclosing bottom member; wherein said enclosing bottom member and said plurality of bumper members form an enclosed area when said enclosing bottom member is in the unfolded position, the enclosed area having a bottom defined by said enclosing bottom member and a plurality of sidewalls defined by said plurality of bumper members connected to and overlying the outer peripheral portion of said enclosing bottom member; and wherein said enclosing bottom member and said plurality of bumper members form a pillow when said enclosing bottom member is in the folded position, the pillow having an outer lining portion defined by said enclosing bottom member, and an inner portion defined by said plurality of bumper members.

2. A system according to claim 1 wherein said plurality of bumper members are detachably connected to one another when said enclosing bottom member is in the unfolded position.

3. A system according to claim 2 wherein said plurality of bumper members are detachably connected to one another using a hook and loop fastener.

4. A system according to claim 1 wherein said plurality of bumper members comprises first, second, third, and fourth bumper members.

5. A system according to claim 1 wherein said plurality of bumper members are partially fixedly connected to an outer peripheral portion of said enclosing bottom member.

6. A system according to claim 1 wherein said plurality of bumper members are detachably connected to outer peripheral portions of said enclosing bottom member.

7. A system according to claim 6 wherein said plurality of bumper members are detachably connected to said enclosing bottom member using a hook and loop fastener.

8. A system according to claim 4 wherein said first and second bumper members are elongate bumper members, each having a first predetermined length; and wherein said third and fourth bumper members each comprise a pair of bumper members, each one of the bumper members in said pair of bumper members having a second predetermined length shorter than the first predetermined length.

9. A system according to claim 8 wherein each of the bumper members in said pair of bumper members are joined together by a seam; and wherein each of said third and fourth bumper members are foldable along the seam.

10. A system according to claim 9 wherein said first and second bumper members are fixedly connected to opposing outer peripheral portions of said bottom enclosing member; wherein the seams of said third and fourth bumper members are fixedly connected to opposing medial outer peripheral portions of said enclosing bottom member; and wherein said third and fourth bumper members fold inwardly along the seam towards the medial portion of said enclosing bottom member and said first and second bumper members are positioned to overlie said third and fourth bumper members when said enclosing bottom member is moved from the unfolded position to the folded position to form a pillow.

11. A system according to claim 9 wherein said first bumper member is fixedly connected to the outer peripheral portion of said enclosing bottom member; and wherein said second, third, and fourth bumper members are detachably connected to the outer peripheral portions of said enclosing bottom member so that when said enclosing bottom member is moved from the unfolded position to the folded position, said second bumper member slides towards said first bumper member and said third and fourth bumper members fold inwardly along the seams to position the seams adjacent an interior medial portion of said enclosing bottom member causing said first, second, third, and fourth bumper members to be adjacent one another when said enclosing bottom member is moved from the unfolded position to the folded position to form a pillow.

12. A system according to claim 1 further comprising a lining overlying said enclosing bottom member.

13. A system according to claim 1 wherein the closure device comprises at least one of a zipper and a plurality of snap fasteners.

14. A system according to claim 1 further comprising at least one handle fixedly connected to the outer peripheral portion of said enclosing bottom member.

15. A combination pillow and enclosed area system comprising: an enclosing bottom member moveable between folded and unfolded positions and comprising a closure device connected to an outer peripheral portion thereof and moveable between opened and closed positions, the closure device comprising at least one of a zipper and a plurality of snap fasteners; first, second, third, and fourth bumper members carried by said enclosing bottom member; said first and second bumper members being fixedly connected to opposing outer peripheral portions of said bottom enclosing members and having a first predetermined length; said third and fourth bumper members each comprising a pair of bumper members, each one of the bumper members in said pair of bumper members having a second predetermined length shorter than the first predetermined length, and each of the bumper members in said pair of bumper members being joined together by a seam; wherein the seams of said third and fourth bumper members are fixedly connected to opposing medial outer peripheral portions of said enclosing bottom member; and wherein said third and fourth bumper members fold inwardly along the seam towards the medial portion of said enclosing bottom member and said first and second bumper members are positioned to overlie said third and fourth bumper members when said enclosing bottom member is moved from the unfolded position to the folded position to form a pillow.

16. A system according to claim 15 wherein said first, second, third, and fourth bumper members are detachably connected to one another when said enclosing bottom member is in the unfolded position.

17. A system according to claim 16 wherein said first, second, third, and fourth bumper members are detachably connected to one another using a hook and loop fastener.

18. A system according to claim 15 further comprising a lining overlying said enclosing bottom member.

19. A system according to claim 15 further comprising at least one handle fixedly connected to the outer peripheral portion of said enclosing bottom member.

20. A combination pillow and enclosed area system comprising: an enclosing bottom member moveable between folded and unfolded positions and comprising a closure device connected to an outer peripheral portion thereof and moveable between opened and closed positions, the closure device comprising at least one of a zipper and a plurality of snap fasteners; and first, second, third, and fourth bumper members carried by said enclosing bottom member; wherein said first bumper member is fixedly connected to the outer peripheral portion of said enclosing bottom member; and wherein said second, third, and fourth bumper members are detachably connected to the outer peripheral portions of said enclosing bottom member so that when said enclosing bottom member is moved from the unfolded position to the folded position, said second bumper member slides towards said first bumper member and said third and fourth bumper members fold inwardly causing said first, second, third, and fourth bumper members to be adjacent one another when said enclosing bottom member is moved to the folded position to form a pillow.

21. A system according to claim 20 wherein said first, second, third, and fourth bumper members are detachably connected to one another when said enclosing bottom member is in the unfolded position.

22. A system according to claim 21 wherein said first, second, third, and fourth bumper members are detachably connected to one another using a hook and loop fastener.

23. A system according to claim 20 wherein said first and second bumper members are elongate bumper members having a first predetermined length; and wherein said third and fourth bumper members each comprise a pair of bumper members, each one of the bumper members in said pair of bumper members having a second predetermined length shorter than the first predetermined length.

24. A system according to claim 23 wherein each of the bumper members in said pair of bumper members are joined together by a seam; and wherein each of said third and fourth bumper members are foldable along the seam.

25. A system according to claim 20 further comprising a lining overlying said enclosing bottom member.

26. A system according to claim 20 further comprising at least one handle fixedly connected to the outer peripheral portion of said enclosing bottom member.

27. A method of converting a combination pillow and enclosed area system from an enclosed area to a pillow, the system comprising an enclosing bottom member moveable between folded and unfolded positions, and first, second, third, and fourth bumper members carried by the enclosing bottom member, the method comprising: folding the third and fourth bumper members inwardly toward a medial portion of the enclosing bottom member; folding the enclosing bottom member upwardly so that the first and second bumper members overlie the third and fourth bumper members when the enclosing bottom member is moved from the unfolded to the folded position.

28. A method according to claim 27 further comprising moving a closure device connected to an outer peripheral portion of the enclosing bottom member from an opened position to a closed position after the enclosing bottom member has been moved to the folded position.

29. A method according to claim 27 wherein the first and second bumper members are fixedly connected to opposing outer peripheral portions of the bottom enclosing members; and wherein the third and fourth bumper members each comprise a pair of bumper members, each of the bumper members in the pair of bumper members being joined together by a seam that is fixedly connected to a medial outer peripheral portion of the enclosing bottom member.

30. A method according to claim 29 wherein folding the third and forth bumper members further comprises folding the third and fourth bumper members inwardly along the seam towards the medial portion of the enclosing bottom member.

31. A method according to claim 27 wherein the first, second, third, and fourth bumper members are detachably connected to one another when the enclosing bottom member is in the unfolded position.

32. A method according to claim 31 wherein the first, second, third and fourth bumper members are detachably connected to one another using a hook and loop fastener.

33. A method of converting a combination pillow and enclosed area system from an enclosed area to a pillow, the system comprising an enclosing bottom member moveable between folded and unfolded positions, and first, second, third, and fourth bumper members carried by the enclosing bottom member, the method comprising: detaching the second, third, and fourth bumper members from outer peripheral portions of the enclosing bottom member; sliding the second bumper member towards the first bumper member that is fixedly connected to the outer peripheral portion of the enclosing bottom member; and folding the third and fourth bumper members inwardly as the second bumper member is moved towards the first bumper member so that the first, second, third, and fourth bumper members are adjacent one another when the enclosing bottom member is moved to the folded position.

34. A method according to claim 33 further comprising moving a closure device connected to the outer peripheral portion of the enclosing bottom member from an opened position to a closed position after the enclosing bottom member has been moved to the folded position.

35. A method according to claim 33 wherein the first bumper member is fixedly connected to an outer peripheral portion of the bottom enclosing members, wherein the second bumper member is detachably connected to an outer peripheral portion of the bottom enclosing member opposite the first bumper member, and wherein the third and fourth bumper members each comprise a pair of bumper members, each one of the bumper members in the pair of bumper members being joined together by a seam.

36. A method according to claim 35 wherein folding the third and forth bumper members further comprises folding the third and fourth bumper members inwardly along the seam.

37. A method according to claim 33 wherein the first, second, third, and fourth bumper members are detachably connected to one another when the enclosing bottom member is in the unfolded position.

38. A method according to claim 37 wherein the first, second, third, and fourth bumper members are detachably connected to one another using a hook and loop fastener.

* * * * *